US012096814B2

(12) United States Patent
Descrovi

(10) Patent No.: US 12,096,814 B2
(45) Date of Patent: Sep. 24, 2024

(54) PROTECTIVE HELMET WITH AIRBAG

(71) Applicant: Locatelli S.p.A., Almenno San Bartolomeo (IT)

(72) Inventor: Roberta Descrovi, London (GB)

(73) Assignee: Locatelli S.p.A., Almenno San Bartolomeo (IT)

( * ) Notice: Subject to any disclaimer, the term of this patent is extended or adjusted under 35 U.S.C. 154(b) by 95 days.

(21) Appl. No.: 17/799,388

(22) PCT Filed: Feb. 12, 2021

(86) PCT No.: PCT/EP2021/053480
§ 371 (c)(1),
(2) Date: Aug. 12, 2022

(87) PCT Pub. No.: WO2021/160817
PCT Pub. Date: Aug. 19, 2021

(65) Prior Publication Data

US 2023/0074709 A1 Mar. 9, 2023

(30) Foreign Application Priority Data

Feb. 14, 2020 (IT) ..... 102020000002998

(51) Int. Cl.
*A42B 3/04* (2006.01)

(52) U.S. Cl.
CPC ..... *A42B 3/0486* (2013.01)

(58) Field of Classification Search
CPC ..... A42B 3/0486; A63B 71/10
See application file for complete search history.

(56) References Cited

U.S. PATENT DOCUMENTS 551,428 A 12/1895 Wilson
5,259,070 A * 11/1993 De Roza ..... A42B 3/122 2/93

(Continued)

FOREIGN PATENT DOCUMENTS

CA 2582040 A1 * 4/2006 ..... A42B 3/06
CN 106901431 A 6/2017

(Continued)

OTHER PUBLICATIONS

International Search Report: European International Search Report for corresponding International Patent Application No. PCT/EP2021/053480 dated May 21, 2021, 3 pages.

*Primary Examiner* — Katherine M Moran
(74) *Attorney, Agent, or Firm* — Patterson Intellectual Property Law, PC

(57) ABSTRACT

A protective helmet (1) comprises a cap (10) adapted to be fitted on and around the head of a user, wherein the cap (10) comprises an external shell (101) and at least one housing seat (102) for an airbag (2). At the at least one housing seat (102), the external shell (101) comprises at least a movable portion (103; 103*a*, 103*b*, 103*c*), which is permanently connected to a remaining fixed portion of the external shell (101) and is movable between a closed position, in which it covers the at least one housing seat (102) and an airbag (2) housed therein in a deflated condition, and an open position, in which it releases at least partially the at least one housing seat (102) allowing the airbag (2) to expand outside the cap (10) in an inflated condition.

20 Claims, 6 Drawing Sheets

(56) References Cited

U.S. PATENT DOCUMENTS

| | | | | |
|---|---|---|---|---|
| 5,287,562 | A * | 2/1994 | Rush, III | A63B 71/10 2/415 |
| 10,143,259 | B2 | 12/2018 | Liao et al. | |
| 2023/0248101 | A1 * | 8/2023 | Mazzarolo | A41D 13/0512 2/468 |

FOREIGN PATENT DOCUMENTS

| | | | |
|---|---|---|---|
| DE | 1944821 | A1 | 3/1971 |
| TW | M551428 | U | 11/2017 |

* cited by examiner

FIG.2
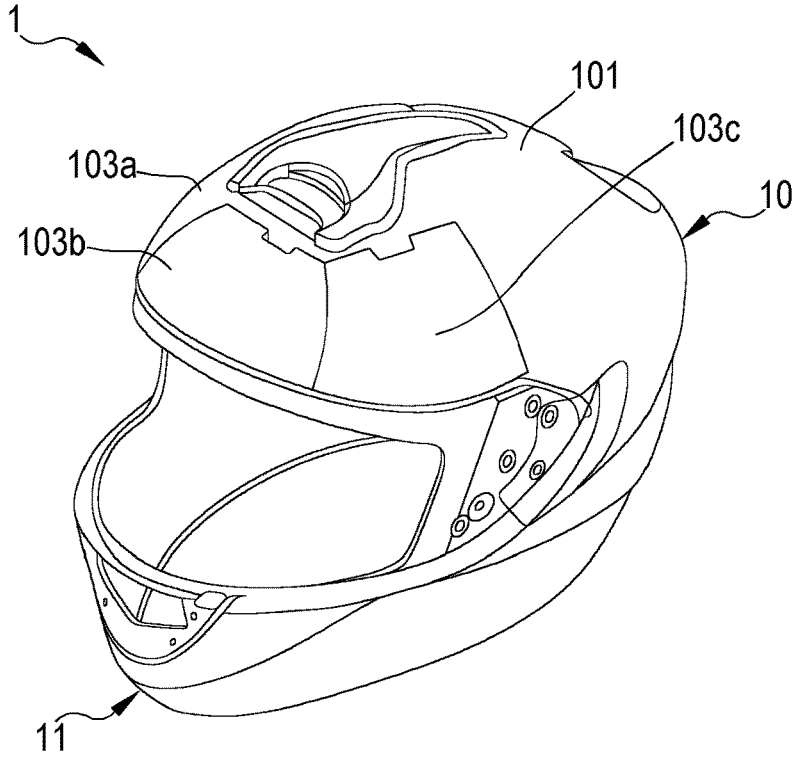
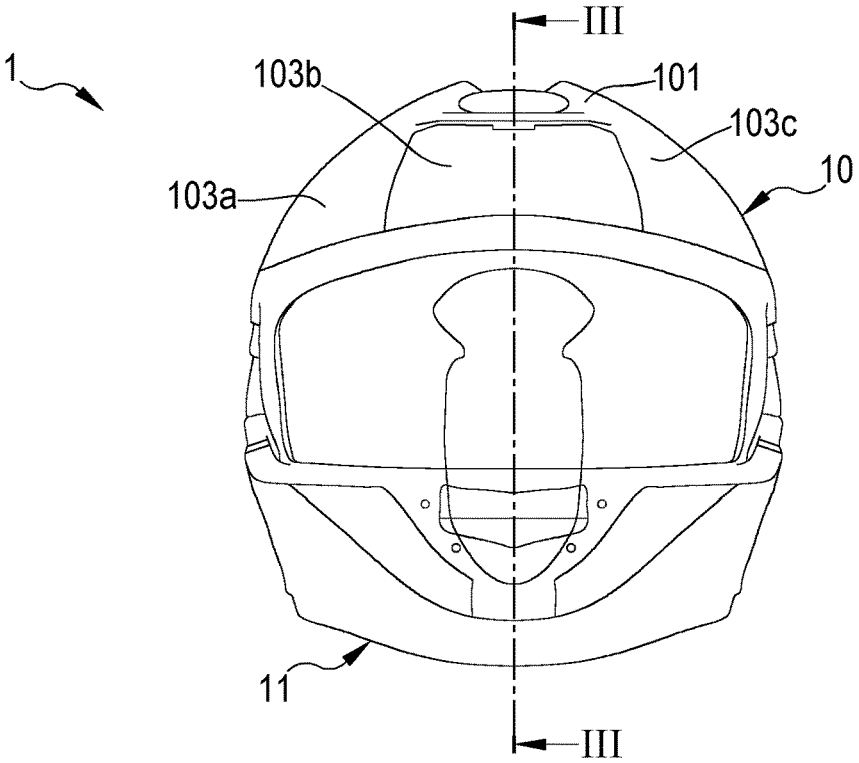
FIG.3

FIG.4
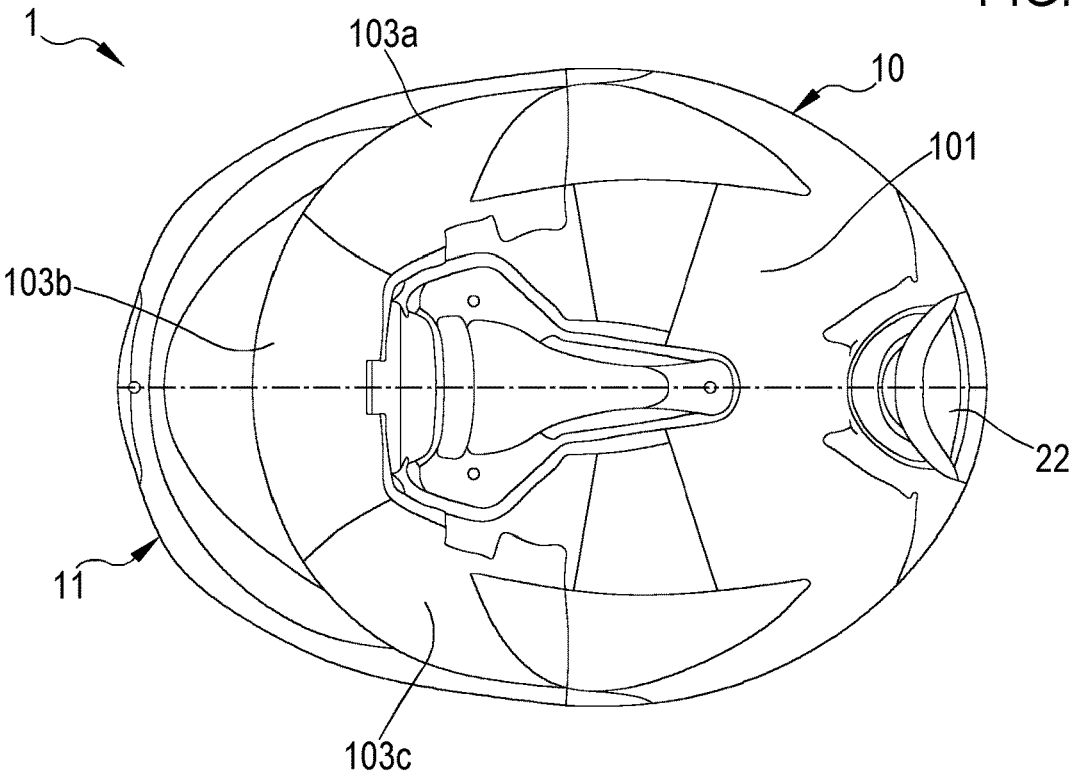
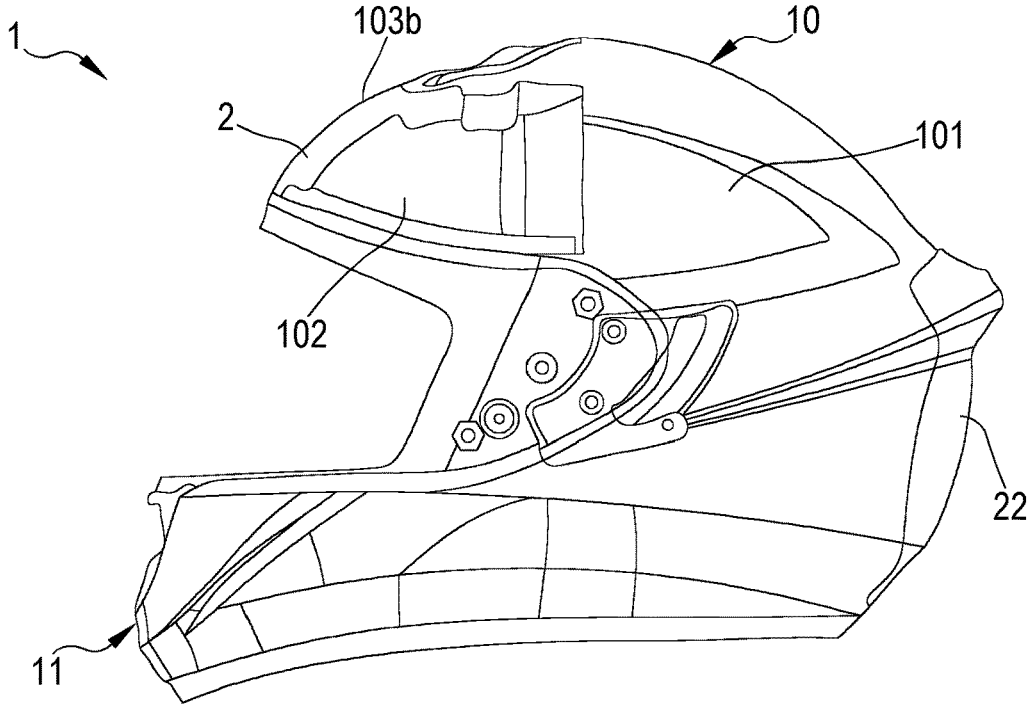
FIG.5

FIG.6
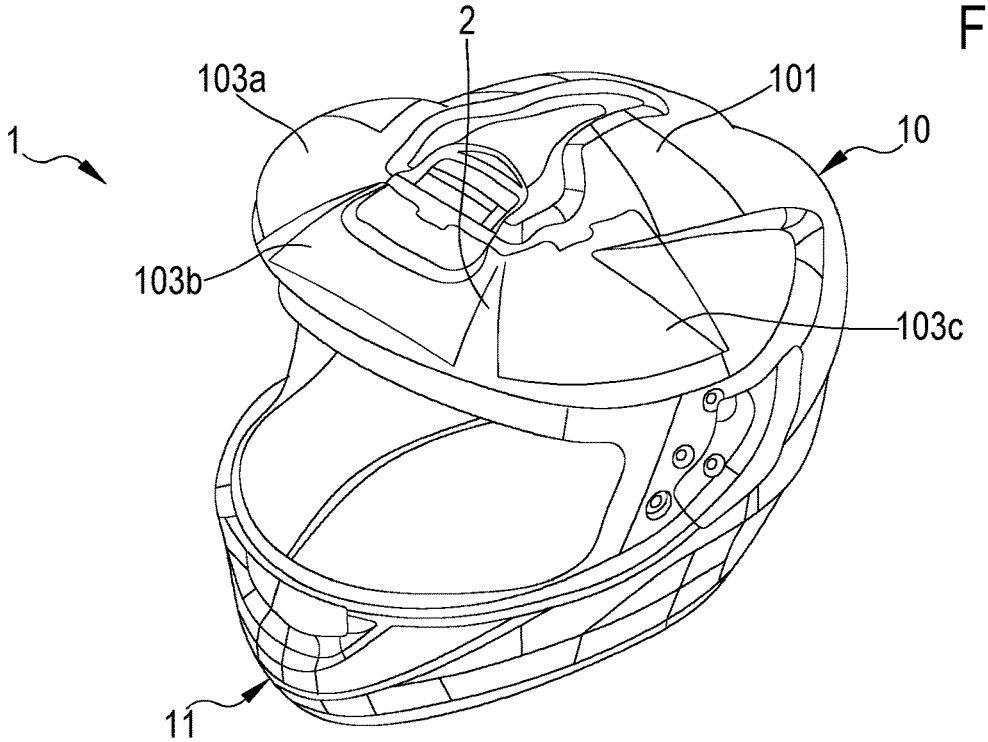
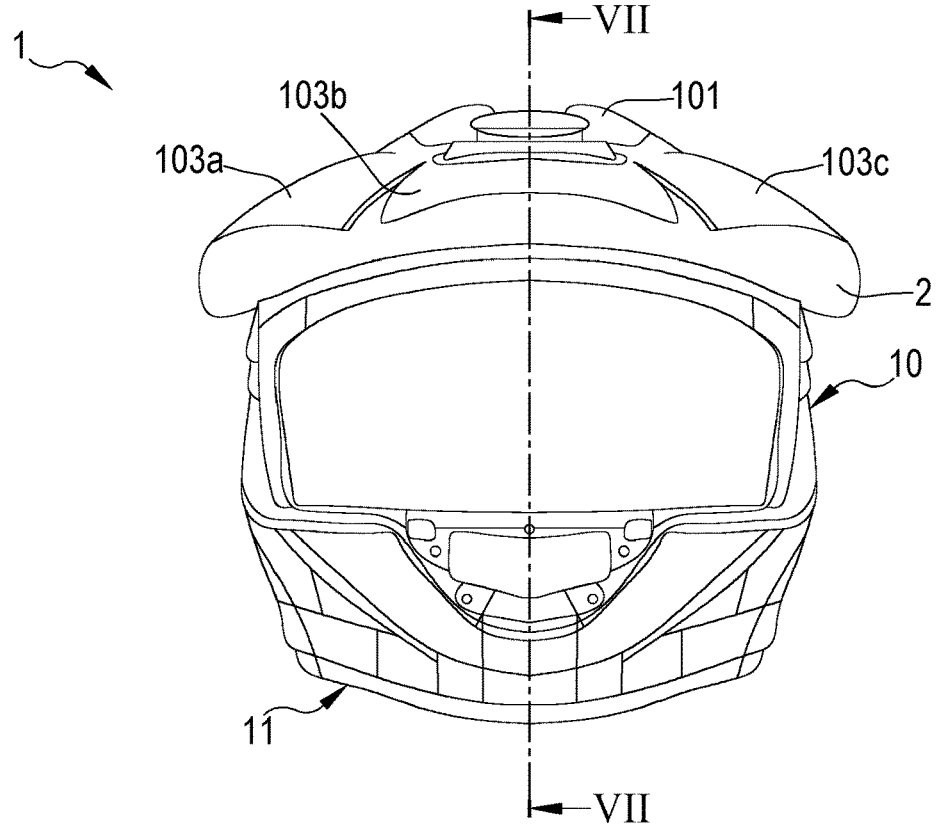
FIG.7

FIG.8
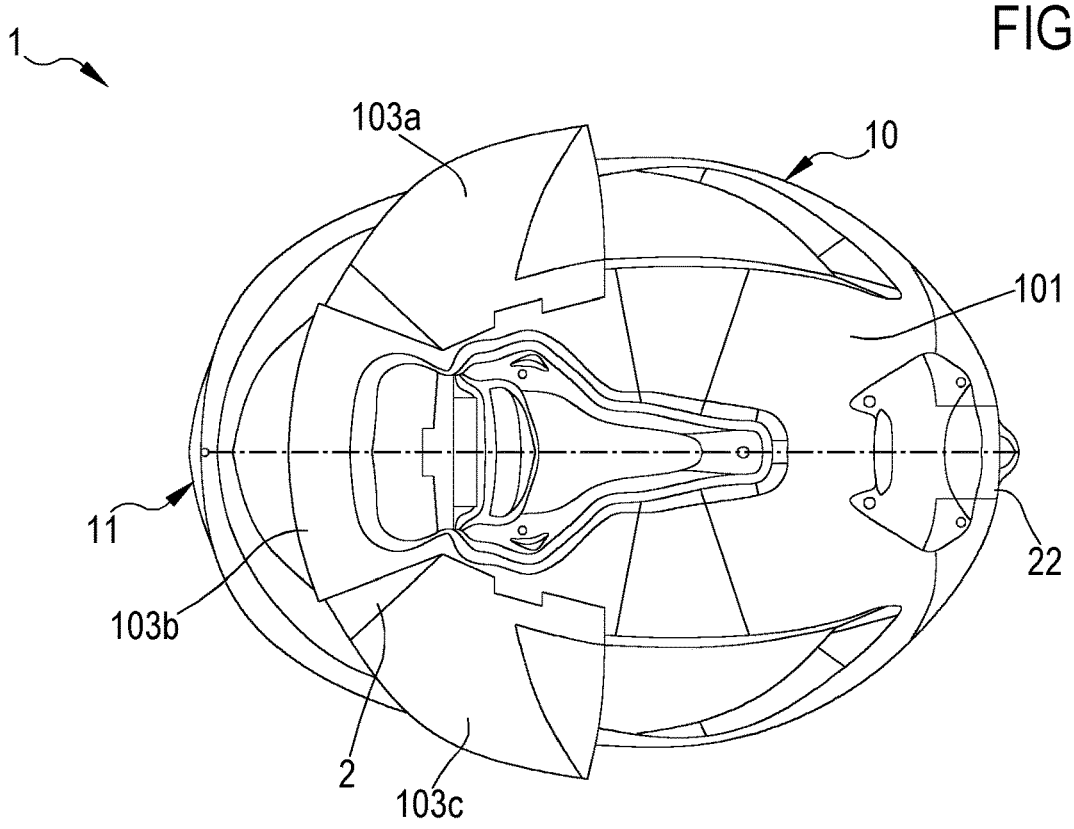
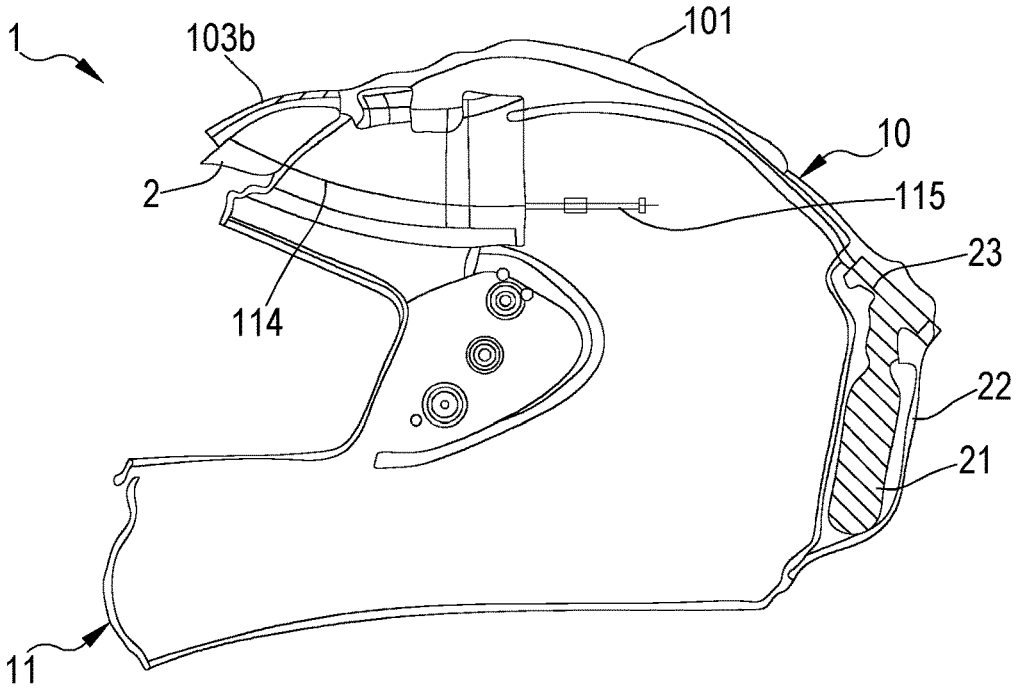
FIG.9

PROTECTIVE HELMET WITH AIRBAG

The present invention relates to a protective helmet provided with an airbag, which has a preferred, although not exclusive, use as a motorcycle helmet.

Protective helmets are commonly used in various fields, including, for example, driving vehicles, playing sports and carrying out work activities, whenever it is necessary to provide specific protection to a user's head against accidental impacts of or with objects or structures that can cause more or less serious injuries or trauma to the user.

In their most general form, the known protective helmets comprise a cap which can be fitted on and around the head of a user, which comprises a rigid and resistant external shell, typically made of a hard plastic or a composite material formed by a reinforced polymeric matrix with high strength fibres. In addition, the cap typically also comprises an internal lining made of a resilient material, adapted to absorb and dissipate as much as possible an impact force acting on the helmet, preventing it from being completely transferred to the user's head.

Since, for reasons of space, the thickness and/or the extension of the aforementioned resilient internal lining of the cap cannot exceed a certain limit, in order to further increase the protection capacity of known protective helmets, protective helmets provided with airbag have been proposed, according to a concept similar to that of airbag systems for passenger cars. Normally the airbag is housed in a deflated condition in a special seat in the helmet. Only in the event of an impact, and in particular when the intensity of the latter exceeds a predetermined threshold, the airbag is activated, i.e. inflated, by means of a special activation system. This solution allows to temporarily provide an additional protective layer, which further contributes to mitigate the effects of an impact, without significantly increasing the size of the helmet itself in conditions of normal use.

Document CN20439348 U discloses a safety helmet with double airbag. The safety helmet comprises a cap divided horizontally into a body portion and a top portion, which in normal conditions are kept joined together by means of a plurality of connecting elements having a frangible portion. An inflatable airbag is housed in the internal volume of the top portion. When the top portion of the cap undergoes an impact, a pressure sensor placed on its outer surface measures the intensity of the impact force and if necessary activates the airbag through a control device and a pyrotechnic-type trigger device. Following the inflation of the airbag, a pressure acts on the top portion which tends to move it away from the base portion, causing the breakage of the connecting elements and the complete detachment of the top portion with respect to the base portion, so as to allow expansion of the airbag outside the helmet.

In the current state of the art there are no known devices in which the airbag is protected by an external shell, without which, even at low impact speeds, the airbag would be torn or damaged by abrasion or on the asphalt or other surfaces.

In protective helmets with airbags of the type described above, the activation of the airbag and its expansion outside the cap cause the complete detachment of one or more portions of the cap or its external shell with respect to respective fixed portions. In addition to the possibility of their loss, the detached portions can no longer be reassembled on the fixed portion of the cap or shell once the airbag has finished performing its function and has deflated. In these protective helmets, therefore, an activation of the airbag makes the helmet in itself unusable, regardless of the actual structural and/or functional damage that the helmet may have suffered.

In general, helmets with known types of airbags have a cushion that inflates completely outside the helmet cap and are subject—even at relatively low impact speeds—to abrasions, lacerations and damage following contact and sliding on the surface of the ground. Typically they are therefore only suitable for uses in which potential collisions occur at very low speed, for example for driving bicycles.

In light of the above, the main object of the present invention is to provide a protective helmet provided with an airbag which, after activation of an airbag incorporated therein, can be easily reassembled and returned to its normal configuration, so as to be possibly used again.

Another object of the present invention is to provide a protective helmet provided with an airbag wherein the airbag is protected from abrasion, thus avoiding the tearing or partial or total damage thereof.

A further object of the present invention is to provide a protective helmet provided with an airbag with the above features which can also be manufactured easily and at competitive costs.

These objects are achieved according to the invention by means of a protective helmet having the features set out in the appended claim 1. Preferred aspects of this helmet are the subject of the dependent claims.

In particular, the present invention relates to a protective helmet comprising a cap which can be fitted on and around the head of a user, wherein the cap comprises an external shell and at least one housing seat for an airbag. At the at least one housing seat, the external shell comprises at least a movable portion, which is permanently connected to a remaining fixed portion of the external shell and is movable between a closed position, in which it covers the at least one housing seat and an airbag housed therein in a deflated condition, and an open position, in which it releases at least partially the at least one housing seat allowing the airbag to expand outside the cap in an inflated condition.

Advantageously, in this protective helmet the portions of the cap or, more precisely, of its external shell, involved in an activation of an airbag are movable portions, but permanently connected to the remaining fixed portion of the cap or to its external shell. The activation of the airbag involves the passage of these movable portions from a closed position to an open portion without their complete detachment from the rest of the protective helmet. Once the airbag has finished performing its protective function, has deflated and has been repositioned in its respective housing, these movable portions can be easily returned to their closed position, so that the helmet takes its normal configuration and, if appropriate in terms of safety, can still be used. Such a possibility can be useful, for example, in the event of accidental activation of the airbag, or not following an actual impact suffered by the helmet, or in the case of minor impacts, which, despite having caused the activation of the airbag, have not compromised the structural and functional integrity and safety of the helmet.

Advantageously, moreover, the implementation of the technical solution described above does not require the development of a completely new helmet from scratch and, correspondingly, the development of new production processes and the preparation of new means of production, but it can take place relatively simply in many types of protective helmet commonly in use, particularly in the field of motorcycle helmets. Consequently, with the present invention it is possible to offer on the market products which are improved in terms of safety and functionality while maintaining competitive prices.

Preferably, in the open position the at least one movable portion of the external shell at least partially covers the airbag in the inflated condition. Advantageously, in this way, even in the inflated condition, and in particular while an impact is taking place, the airbag is at least partially protected externally, in such a way as to avoid tears, perforations or damages of any other type that could cause an early deflation, thus nullifying its protective function.

According to a preferred embodiment of the present invention, the at least one movable portion of the external shell is pivotable with respect to the fixed portion of the external shell. This embodiment advantageously allows combining a relatively simple implementation of the invention with an effective and reliable operation. Basically, in this case the at least one movable portion of the external shell defines a door or leaf hinged to the fixed portion of the external shell and capable of pivoting between the closed position and the open position.

Preferably, the at least one movable portion and the fixed portion of the external shell can be mutually hinged along a perimeter edge portion of the at least one movable portion and of a corresponding perimeter edge portion of the at least one housing seat.

More preferably, the aforesaid perimeter edge portions of the at least one movable portion and of the at least one housing seat have respective mutually conjugated profiles and are joined together at said mutually conjugated profiles by means of a rotation pin.

This choice advantageously allows preserving the superficial continuity of the external shell, avoiding any raised or depressions therein, if not already provided for other purposes. This is particularly desirable in cases in which the shape of the external shell must also meet aerodynamic criteria, as occurs for example in motorcycle helmets.

Alternatively, one of the perimeter edge portion of the movable portion and the perimeter edge portion of the at least one housing seat can comprise a longitudinally extending slit and the other between said perimeter edge portions can comprise a shaped portion pivotally inserted in said slit. In this way, a "slip in" type hinge is obtained, which implements the pin rotation connection without additional elements, such as rotation pins, in addition to the hinged parts themselves, and is therefore particularly simple from the structural point of view and easy and quick to assemble.

According to another embodiment of the invention, the at least one movable portion of the external shell is translatable with respect to the fixed portion of the external shell.

This embodiment allows obtaining a particularly precise and robust guide of the at least one movable portion in the transition from the closed position to the open position and vice versa, in particular when "drawer-like" sliding movements of the at least one movable part are implemented under the pressure of the inflating airbag.

Preferably, the protective helmet also comprises releasable retaining means adapted to keep the at least one movable portion of the external shell in the closed position when the airbag is in a deflated condition and to allow automatic opening of the at least one movable portion when a pressure exerted by the airbag during inflation exceeds a predetermined threshold value.

Preferably, the releasable retaining means are permanently associated with the at least one movable portion of the external shell. This provides further guidance for the opening and closing movements of the at least one movable portion and, in the open position, contributes to maintaining the latter in contact with or in close proximity to the inflated airbag, so as to protect it during the impact.

In an embodiment that is particularly simple and compact from the constructive point of view, as well as effective and reliable from the functional point of view, the releasable retaining means comprise a retaining cable having ends fixed to the cap with the interposition of elastic traction means at points of the cap substantially opposite with respect to the at least one movable portion of the external shell and passing through at least one hole or channel formed in the at least one movable portion of the external shell.

In particular, in the case of protective motorcycle helmets, it is advantageous for the at least one housing seat to extend into a frontal region and temporal regions adjacent thereto of the cap. In fact, it was found in motorcycle helmets that these areas are statistically among the most subject to impact in the event of an accident.

In this case, if a pivotal rotation movement of the at least one movable portion with respect to the fixed portion of the external shell is provided, it is advantageous to provide several movable portions to cover the surface of the at least one housing seat of the airbag, preferably a front movable portion and a pair of temporal movable portions, each of which is permanently connected to the fixed portion of the external shell and is movable between said closed and open positions.

Preferably, in this case, the front movable portion and the pair of temporal movable portions may be at least partially connected to each other at mutually adjacent areas by means of a sheet of elastic and/or flexible material able to elastically extend or unfold when said movable portions pass from the closed position to the open position. The presence of this sheet of elastic and/or flexible material is useful for providing protection to the inflated airbag even in areas not covered by the movable portions when these are in the respective open position.

Preferably, the protective helmet according to the invention comprises an airbag activation system operating without electrically powered devices. More preferably, the airbag activation system comprises a container with a pressurized gas in fluid communication with the airbag and a mechanical-type trigger device for initiating a flow of pressurized gas from the container to the airbag.

In the case of use for motorcycling, the protective helmet of the invention can advantageously also comprise a chin guard associated in a fixed or movable manner with the cap, so as to provide a helmet of the integral type or, respectively, of the modular type.

Further features and advantages of a protective helmet according to the present invention will become more apparent from the following detailed description of preferred embodiments thereof, given below, by way of non-limiting example, with reference to the accompanying drawings, in which:

FIG. 2 is a schematic perspective view of the protective helmet of FIG. 1 in a first operating configuration;

FIG. 3 is a schematic front view of the protective helmet of FIG. 2;

FIG. 4 is a schematic top view of the protective helmet of FIG. 2;

FIG. 5 is a schematic sectional view along the line III-III of FIG. 3 of the protective helmet of FIG. 2;

FIG. 6 is a schematic perspective view of the protective helmet of FIG. 1 in a second operating configuration;

FIG. 7 is a schematic front view of the protective helmet of FIG. 6;

FIG. 8 is a schematic top view of the protective helmet of FIG. 6;

FIG. 9 is a schematic sectional view along the line VII-VII of FIG. 7 of the protective helmet of FIG. 6;

Figure 1:
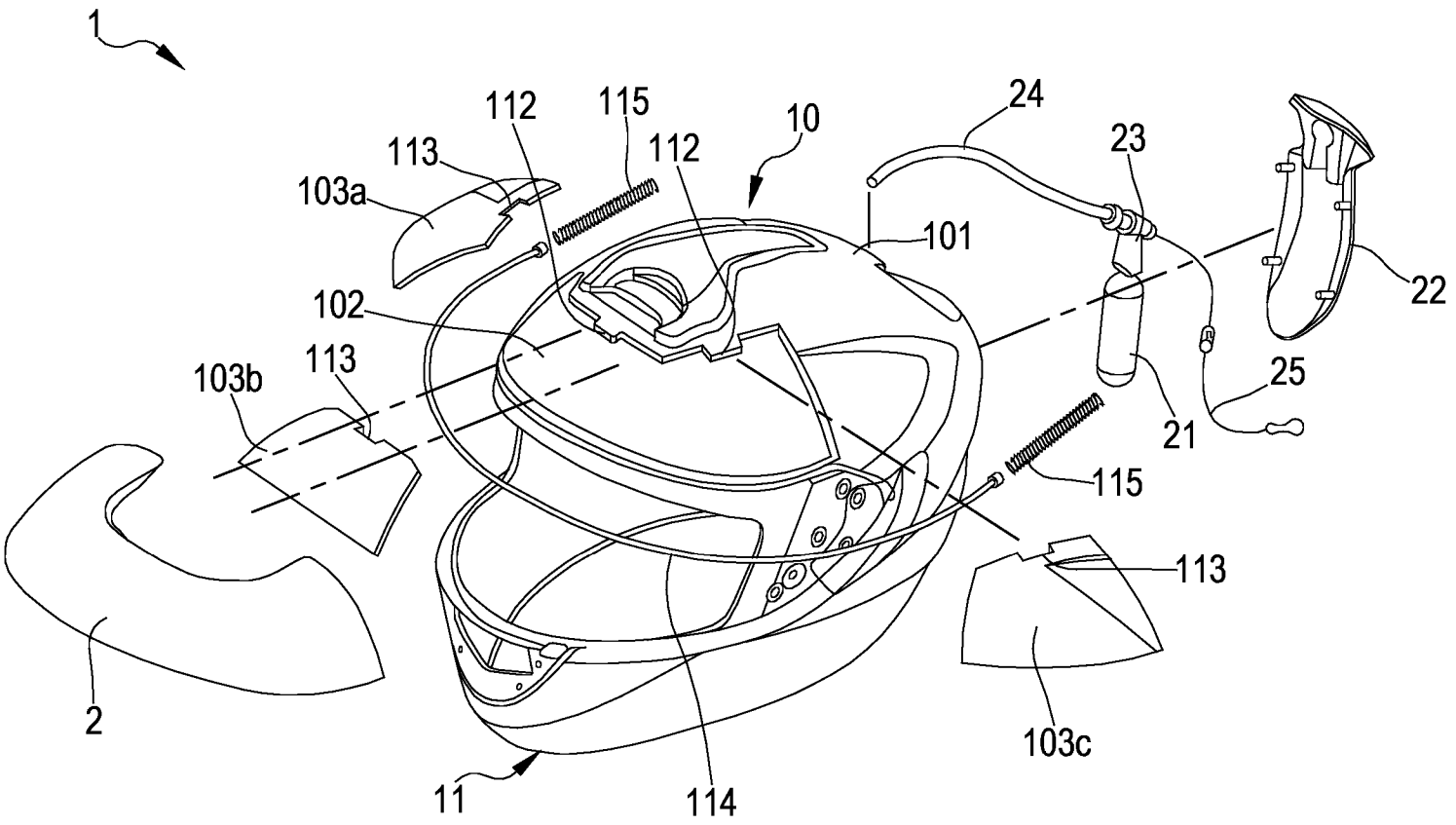
FIG. 1 is an exploded perspective schematic view of a preferred embodiment of a protective helmet according to the present invention.
Figure 10:
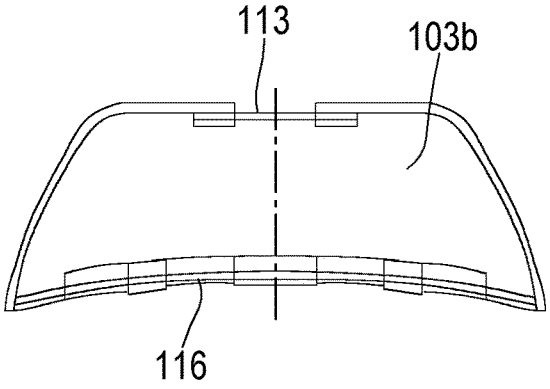
FIG. 10 is a schematic front view of the rear side of a movable portion of the shell of the protective helmet of FIG. 1.
Figure 11:
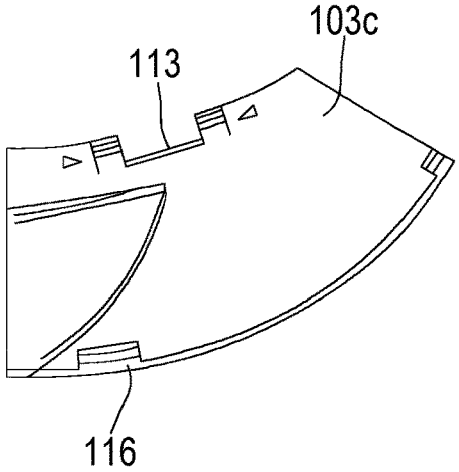
FIG. 11 is a schematic front view of the rear side of a second movable portion of the shell of the protective helmet of FIG. 1.

In these figures a protective helmet according to the invention is indicated as a whole with the reference numeral 1.

The protective helmet 1 shown herein is in particular a motorcycle helmet. However, the concepts underlying the present invention and the specific technical solutions described below can also find application in protective helmets intended for other uses, such as driving motor vehicles in general, both in everyday life and in sports, in sporting activities, for example cycling or mountain biking, skiing/snowboarding, mountaineering, hockey, baseball, etc., or carrying out work activities in environments or conditions in which there is a particular danger of accidents affecting the head.

The protective helmet 1 comprises a cap 10 configured to wrap and protect the front, top, rear and side areas of a user's head. In the embodiment shown herein, the protective helmet 1 further comprises a chin guard 11 to also protect the mandibular area of the user's head. In this case, the chin guard 11 is formed integrally with the cap 10, so as to constitute a helmet of the integral type. However, the chin guard 11 could also be associated in a movable manner with the cap 10, so as to provide a helmet of the so-called modular type.

The protective helmet 1 can also comprise in a known manner a visor, not shown in the figures.

The cap 10 and the chin guard 11 comprise an external shell 101 made of a rigid and resistant material, in particular a hard plastic, such as for example acrylonitrile butadiene styrene (ABS) or polycarbonate (PC), or a composite material containing high strength fibres, such as glass fibres, carbon fibres or aramid fibres. Preferably, in the case of the protective helmet 1 described herein, the cap 101 is made of a composite material comprising a polymer matrix reinforced with carbon fibres.

The cap 10 and the chin guard 11 typically also comprise an internal lining, not shown in the figures, made of a resilient material, such as sintered expanded polystyrene (EPS), adapted to absorb and dissipate as much as possible the impact forces acting on the protective helmet. 1, so that they do not directly and completely transfer to the user's head. Even more internally than the internal lining, a padding made of soft material, also not shown in the figures, can be provided to make contact of the helmet with the user's head more comfortable.

As a further protective element, an airbag 2 is also provided in the protective helmet 1, visible in FIGS. 1, 6-9 and 12, which can be activated, i.e. inflated, by means of an activation system described in more detail below, when the protective helmet 1 undergoes an impact of an intensity higher than a predetermined threshold or, in general, upon the occurrence of pre-established conditions that are a prelude to an impact.

In a non-active condition, that is, deflated, the airbag 2 is housed suitably folded, in a suitable housing 102 formed in the cap 10. In the case of a protective helmet 1 for motorcycling, as in the example illustrated herein, it is advantageous to arrange the airbag 2 at the frontal region and the two adjacent temporal regions of the head, since it has been found that in these regions, impacts occur more frequently in the event of an accident. Correspondingly, the housing seat 102 extends, preferably continuously, in the frontal region and in the two temporal regions, opposite and adjacent to the frontal region, of the cap 10.

In the example of embodiment shown herein, the airbag 2 is made as a single body, however it is also possible to contemplate embodiments in which the airbag 2 consists of two or more distinct portions, which can be inflated independently, which together cover the aforementioned regions.

At the housing seat 102, the external shell 101 comprises a front movable portion 103*b* and two temporal movable portions 103*a* and 103*c*, configured to completely cover together the housing seat 102 and the airbag 2 housed therein in normal use conditions of the protective helmet 1, i.e. when the airbag 2 is deflated, and to release the housing seat 102, allowing the expansion of the airbag 2 in the event of an impact. In particular, each of the movable parts 103*a*, 103*b* and 103*c* is permanently connected to a remaining fixed portion of the external shell 101 and can move between a closed position, shown in FIGS. 2-5, in which it covers a respective portion of the housing seat 102 and of the airbag 2 housed therein in a deflated condition, and an open position, shown in FIGS. 6-9, in which it releases the respective portion of the housing seat 102, allowing the airbag 2 to expand outside the cap 10 when inflated.

In the protective helmet 1 according to the invention, therefore, the activation of the airbag 2 does not involve a complete detachment of parts of the external shell 101 or, more generally, of the cap 10. Even when the airbag 2 is activated, the movable portions 103*a*, 103*b* and 103*c* remain constrained to the remaining fixed part of the external shell 101. Once the airbag 2 has completed its protective function, has deflated and has been repositioned in the housing 2, in the absence of other structural or functional damage to the helmet, the movable portions 103*a*, 103*b* and 103*c* can be easily returned to their closed position, restoring the normal configuration of the protective helmet 1, which, if appropriate from a safety point of view, can continue to be used.

Advantageously, the deflation of the airbag and its repositioning in the housing seat take place through the mechanical action of the movable parts thereon.

The number of movable portions covering the housing seat 2 can vary from one to a plurality depending on the specific application requirements, based, for example, on the type of protective helmet 1, on the shape of its cap 2 or its external shell 101, on the position of the housing seat 102 on the cap 2, on the dimensions and shape of the housing seat 2, on the type of movable connection between movable parts and fixed part of the external shell 101.

As can be seen in particular from FIG. 5, the movable portions 103*a*, 103*b* and 103*c* are configured and movable in such a way that in the open position they cover at least partially, and preferably substantially, the airbag 2 in an inflated condition, to protect it from possible lacerations or perforations during an impact.

As a further protection, in particular to cover areas of the airbag 2 which may remain exposed due to a mutual removal of the movable portions 103*a*, 103*b* and 103*c* following their opening (see FIGS. 6-8), the latter can be advantageously connected to each other at mutually adjacent areas by means of a sheet of elastic and/or flexible material (not shown in the figures) capable of elastically extending or unfolding when the movable portions 103*a*, 103*b* and 103*c* move from the closed position to the open position.

In the embodiment of the protective helmet 1 shown in FIGS. 1-11 the movable portions 103*a*, 103*b*, 103*c* are connected to the fixed portion of the external shell 101 in a pivotable manner. In particular, as can be better seen from FIGS. 1, 10 and 11, each movable portion 103*a*, 103*b*, 103*c* comprises a respective portion 113 of perimeter edge hinged to a corresponding portion 112 of the perimeter edge of the housing seat 102. The perimeter edge portions 113 of the movable portions 103*a*, 103*b*, 103*c* and the corresponding perimeter edge portions 112 of the housing seat 102 have a mutually conjugated profile, in particular in the form, respectively, of recesses and projections and are joined together by means of a rotation pin (not shown in the figures) which can be inserted in suitable seats formed at the portions 113, 112 themselves. Of course, other pin connection modes are also possible between the movable portions 103*a*, 103*b*, 103*c* and the fixed portion of the external shell 101. For example, in an alternative embodiment, not shown in the figures, the pin connection can be made by coupling ("slip-in" hinge), forming slits extending longitudinally in the portions 112 of the perimeter edge of the housing seat 102 and providing the perimeter edge portions 113 of the movable portions 103*a*, 103*b*, 103*c* for example with a Z-shape, such as to allow a fixed connection, with the possibility of pivoting, with said slits.

In the protective helmet 1 there are also releasable retaining means, adapted to keep the movable portions 103*a*, 103*b*, 103*c* in the closed position when the airbag 2 is deflated and to allow automatic opening of the same when a pressure exerted by the airbag 2 during inflation exceeds a predetermined threshold value. As can be seen in particular in FIG. 1, these releasable retaining means preferably comprise a retaining cable 114 having respective ends fixed through the interposition of traction springs 115 to the external shell 101 or, in general, to the cap 10 from laterally opposite parts of the housing seat 102 and passing through one or more holes or channels 116 formed in each of the movable portions 103*a*, 103*b*, 103*c*, visible in particular in FIGS. 10 and 11. The retaining cable 115 therefore remains stably connected to the movable portions 103*a*, 103*b*, 103*c* both in the closed position and in the open position thereof. By suitably choosing the elastic features of the traction springs 115, it is possible to set different pressure threshold values for opening the movable portions 103*a*, 103*b*, 103*c* due to the inflation of the airbag 2.

Figure 12:
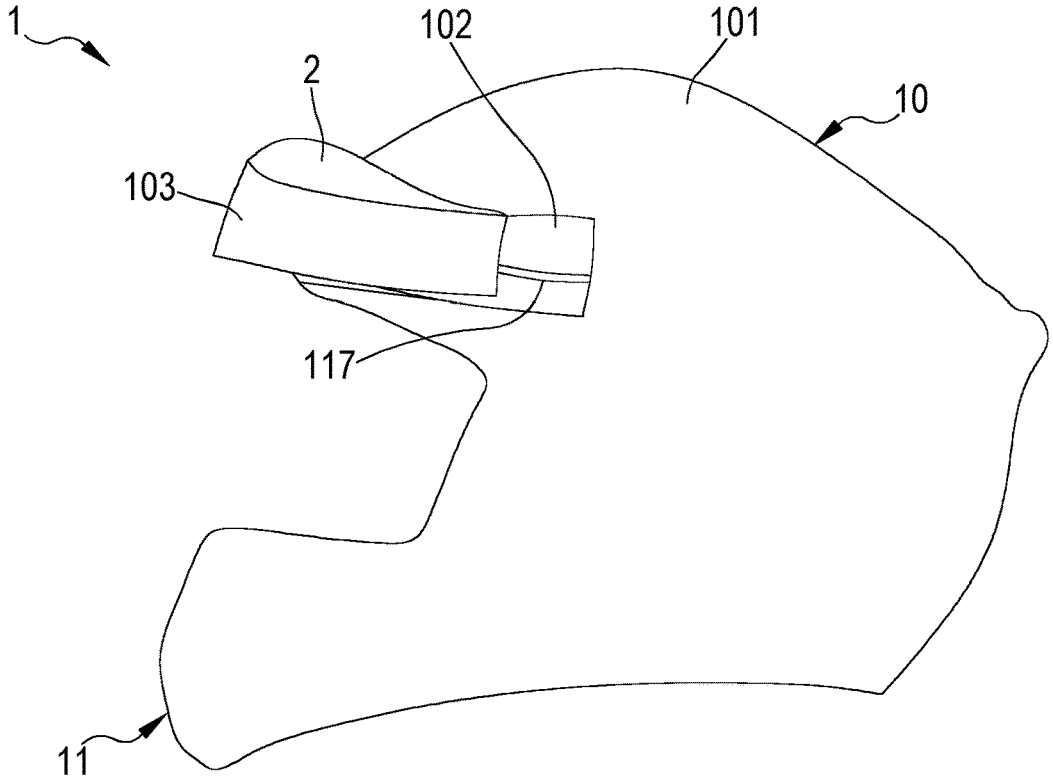
FIG. 12 is a schematic side view of an alternative embodiment of a protective helmet according to the present invention.

FIG. 12 shows an alternative embodiment of the protective helmet 1, in which the housing seat 102 of the airbag 2 is completely covered by a single movable portion 103, substantially U-shaped, of the external shell 101 and is permanently connected to the fixed portion of the latter in a translatable manner. In particular, the movable portion 103 is connected to the fixed portion of the external shell 101 by means of guiding devices 117 arranged at the two opposite temporal regions of the protective helmet 1, only one of which is visible in the side view of FIG. 12, and can translate along a substantially horizontal direction, with reference to the conditions of normal use of the helmet when worn by a user, between a closed position and an open position (illustrated in FIG. 12). Also in this case, in the open position, the movable portion 103 substantially covers the airbag 2 in an inflated condition, protecting it against tears or perforations that could occur during an impact. Furthermore, also in this embodiment releasable retaining means are provided for the movable portion 113, which can be configured in a manner similar to what has been described above with reference to the embodiment of FIGS. 1-11.

As mentioned above, the protective helmet 1 also comprises an airbag activation system 2. This system preferably comprises a cartridge 21 containing a fluid under pressure, for example CO2 at 30 bar at room temperature, therefore in the liquid state before undergoing an expansion towards and inside the airbag 2. To minimize the impact on the aerodynamic features of the protective helmet 1, the cartridge 21 can be conveniently arranged in a vertical position in a rear area of the cap 10 of the protective helmet 1, at the nape of a user's neck when it is worn, and is preferably covered by a special casing 22 removably fixed to the external shell 101.

The cartridge 21 is normally closed by means of a fluid-retaining device or element 23, for example of the perforation type and, when the latter opens, it is placed in fluid communication with the airbag 2 through a duct 24. The cartridge 21 is opened by means of a mechanical trigger system, comprising a trigger cable 25 of suitable length, possibly provided with at least one spiral portion, having a first end connected to the fluid-retaining device or element 23 and a second free end, which in this case is intended to be connected to a fixed point on a motor vehicle driven by the user wearing the protective helmet 1. In the event of an accident, fall or in general an event that causes a variation of a predetermined reciprocal distance between motorcyclist and motor vehicle and typical of a normal riding position, a tension is generated in the trigger cable 25 which, beyond a predetermined threshold, automatically causes the opening of the fluid-retaining device or element 23 of the cartridge 21 and therefore the inflation of the airbag 2, with the concurrent opening of the movable portions 103, i.e. 103*a*, 103*b*, 103*c*.

Following an event, in particular an accident, which caused the activation of the airbag 2, if desired and taking into account any other damage suffered by the protective helmet 1 that may have compromised its structural and/or functional integrity, the deflated airbag 2 can be collected again in the housing seat 102 and the movable portions 103 or 103*a*, 103*b*, 103*c* can be easily returned to their closed position, restoring the normal configuration of use of the protective helmet 1.

With the present invention, therefore, a protective helmet provided with an airbag is provided which can be easily reassembled and returned to its normal configuration after an airbag activation in order to be able to be used again, and which can be manufactured easily and at competitive costs starting from existing helmet models.

It is clear that a man skilled in the art may make changes and variants to the protective helmet described herein in order to meet specific and incidental application requirements, changes and variants in any case falling within the scope of protection defined in the following claims.

In particular, the number and position of the seats for housing an airbag and the associated movable portions of the external shell may vary according to the type of protective helmet and the intended use thereof.

The invention claimed is:

1. A protective helmet comprising:

a cap configured to be fitted on and around the head of a user, wherein the cap includes an external shell and at least one housing seat for an airbag, wherein, at the at least one housing seat, the external shell comprises at least one movable portion, which is permanently connected to a remaining fixed portion of the external shell and is movable between a closed position, in which the at least one movable portion covers the at least one housing seat and an airbag housed therein in a deflated condition, and an open position, in which the at least one movable portion releases at least partially the at least one housing seat allowing the airbag to expand outside the cap in an inflated condition, wherein in the open position the at least one movable portion of the external shell covers at least partially the airbag in an inflated condition.

2. The protective helmet of claim 1, wherein the at least one movable portion of the external shell is pivotable with respect to the fixed portion of the external shell.

3. The protective helmet of claim 2, wherein the at least one movable portion and the fixed portion of the external shell are mutually hinged at a perimeter edge portion of the at least one movable portion and at a corresponding perimeter edge portion of the at least one housing seat.

4. The protective helmet of claim 3, wherein the respective perimeter edge portions of the at least one movable portion and of the at least one housing seat have respective mutually conjugated profiles and are joined together at said mutually conjugated profiles by means of a rotation pin.

5. The protective helmet of claim 3, wherein:

one of the perimeter edge portion of the at least one movable portion or the perimeter edge portion of the at least one housing seat comprises a slit extending longitudinally; and the other of the perimeter edge portion of the movable portion and the perimeter edge portion of the at least one seat housing comprises a shaped portion pivotally inserted in said slit.

6. The protective helmet of claim 1, wherein the at least one movable portion of the external shell is translatable with respect to the fixed portion of the external shell.

7. The protective helmet of claim 1, comprising releasable retaining means for maintaining the at least one movable portion of the external shell in the closed position when the airbag is in a deflated condition and allowing automatic opening of the at least one movable portion when a pressure exerted by the airbag during inflation exceeds a predetermined threshold value.

8. The protective helmet of claim 7, wherein the releasable retaining means are permanently associated with the at least one movable portion of the external shell.

9. The protective helmet of claim 1, further comprising a retaining cable having ends fixed to the cap with an interposition of elastic traction springs at points of the cap substantially opposite to the at least one movable portion of the external shell and passing through at least one hole or channel formed in the at least one movable portion of the external shell.

10. The protective helmet of claim 1, wherein the at least one housing seat extends in a frontal region and in temporal regions adjacent to the frontal region of the cap.

11. The protective helmet of claim 1, comprising a chin guard associated in a fixed or movable manner with the cap.

12. A protective helmet comprising:

a cap configured to be fitted on and around the head of a user, wherein the cap includes an external shell and at least one housing seat for an airbag, wherein, at the at least one housing seat, the external shell comprises at least one movable portion, which is permanently connected and pivotable with respect to a remaining fixed portion of the external shell and is movable between a closed position, in which the at least one movable portion covers the at least one housing seat and an airbag housed therein in a deflated condition, and an open position, in which the at least one movable portion releases at least partially the at least one housing seat allowing the airbag to expand outside the cap in an inflated condition.

13. The protective helmet of claim 12, wherein the at least one movable portion and the fixed portion of the external shell are mutually hinged at a perimeter edge portion of the at least one movable portion and at a corresponding perimeter edge portion of the at least one housing seat.

14. The protective helmet of claim 13, wherein the respective perimeter edge portions of the at least one movable portion and of the at least one housing seat have respective mutually conjugated profiles and are joined together at said mutually conjugated profiles by means of a rotation pin.

15. The protective helmet of claim 13, wherein:

one of the perimeter edge portion of the at least one movable portion or the perimeter edge portion of the at least one housing seat comprises a slit extending longitudinally; and the other of the perimeter edge portion of the movable portion and the perimeter edge portion of the at least one seat housing comprises a shaped portion pivotally inserted in said slit.

16. The protective helmet of claim 12, wherein the at least one housing seat extends in a frontal region and in temporal regions adjacent to the frontal region of the cap.

17. The protective helmet of claim 16, wherein at the at least one housing seat the external shell comprises a movable front portion and a pair of temporal movable portions, each of which is permanently connected to the fixed portion of the external shell and is movable between the closed and open positions.

18. The protective helmet of claim 17, wherein the front movable portion and the pair of temporal movable portions are at least partially connected to each other at mutually adjacent areas via a sheet of elastic and/or flexible material configured to elastically extend or unfold when the movable portions pass from the closed position to the open position.

19. A protective helmet comprising:

a cap configured to be fitted on and around the head of a user, wherein the cap includes an external shell and at least one housing seat including an airbag;

a container with a pressurized fluid in fluid communication with the airbag; and a mechanical trigger device configured to trigger a flow of the pressurized fluid from the container to the airbag;

wherein, at the at least one housing seat, the external shell comprises at least one movable portion, which is permanently connected to a remaining fixed portion of the external shell and is movable between a closed position, in which the at least one movable portion covers the at least one housing seat and an airbag housed therein in a deflated condition, and an open position, in which the at least one movable portion releases at least partially the at least one housing seat allowing the airbag to expand outside the cap in an inflated condition.

20. The protective helmet of claim 19, wherein the mechanical trigger device comprises a trigger cable, and wherein a fluid-retaining element of the container is caused to open upon a tension being generated in the trigger cable beyond a predetermined threshold.

* * * * *